US008210234B2

(12) United States Patent
Goettsch

(10) Patent No.: US 8,210,234 B2
(45) Date of Patent: Jul. 3, 2012

(54) COMBUSTION CHAMBER WALL COOLING CHAMBER DESIGN FOR SEMI-PERMANENT MOLD CYLINDER HEAD CASTING

(75) Inventor: David D. Goettsch, Shelby Township, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 0 days.

(21) Appl. No.: 13/024,735

(22) Filed: Feb. 10, 2011

(65) Prior Publication Data

US 2011/0203764 A1 Aug. 25, 2011

Related U.S. Application Data

(60) Provisional application No. 61/306,002, filed on Feb. 19, 2010.

(51) Int. Cl.
*B22D 27/04* (2006.01)

(52) U.S. Cl. ..... 164/126; 164/128; 164/348

(58) Field of Classification Search ..... 164/125–128, 164/348

See application file for complete search history.

(56) References Cited

U.S. PATENT DOCUMENTS 5,704,412 A * 1/1998 Gurdebeke ..... 164/127

FOREIGN PATENT DOCUMENTS

| | | | |
|---|---|---|---|
| DE | 10242559 | A1 | 3/2004 |
| DE | 102006001990 | A1 | 7/2007 |
| DE | 102008012653 | A1 | 9/2009 |
| EP | 2100688 | A1 | 1/2009 |

* cited by examiner

*Primary Examiner* — Kuang Lin
(74) *Attorney, Agent, or Firm* — Dinsmore & Shohl LLP

(57) ABSTRACT

A cooling chamber design that increases the heat transfer over conventional designs during the casting process of an aluminum cylinder head.

10 Claims, 6 Drawing Sheets

COMBUSTION CHAMBER WALL COOLING CHAMBER DESIGN FOR SEMI-PERMANENT MOLD CYLINDER HEAD CASTING

STATEMENT OF RELATED CASES

This application claims the benefit of Provisional Application Ser. No. 61/306,002, filed Feb. 19, 2010, entitled Combustion Chamber Wall Cooling Chamber Design For Semi-Permanent Mold Cylinder Head Casting, which is incorporated herein by reference.

BACKGROUND OF THE INVENTION

The combustion chamber walls in a cylinder head casting are highly stressed during engine operation. High strength material is needed in this area to obtain long life for the component. While alloy selection and heat treatment play an important role in the final strength of the alloy, the conditions during solidification play an equal role. The rate of solidification of the combustion chamber walls is determined by the wall design, mold materials, core materials, cooling design and process variables. The balance between these variables and the alloy used can be difficult to optimize for highest strength.

One of the process variables that must be balanced is mold wall temperature. If the mold wall that forms the combustion chamber is cold, that will increase the solidification rate, but it can be detrimental to the filling of the mold cavity. Excessive loss of metal temperature during mold filling will cause cold shut defects and contribute to sub-surface porosity. A hot mold will minimize the temperature loss of the liquid metal, but it will also lengthen the solidification time of the casting and increase the microstructure size of the combustion chamber wall material. To achieve a hot mold during filling and a cold mold during solidification, mold cooling chambers for the combustion chamber casting walls are typically activated after the mold filling event. To maximize the solidification rate of the casting, maximum high heat flux from the cooling chambers is desired. The design of the mold cooling chamber which forms the combustion chamber casting walls is important in achieving this maximum heat flux during solidification.

A typical measure of microstructure size in aluminum silicon or aluminum copper cast alloys is secondary dendrite arm spacing (SDAS). This measured length is taken from a cut specimen in the combustion chamber wall. A typical SDAS specification is 25 microns maximum in the bridge wall for a high output engine cylinder head. This microstructure length is desirable across the entire combustion chamber face, but is not obtainable with the conventional process.

A conventional semi-permanent mold assembly for an aluminum alloy cylinder head has water cooling chambers below each of the combustion chamber casting walls. The combustion chamber features and cooling lines are typically made with individual tools which insert into the larger base mold. These inserts are precisely located and secured to the base mold from below, typically with a location dowel pin and four bolt bosses. The cooling line input and exit tubing are also connected from below. The cooling chamber needs clearance from these features, which severely restricts its size.

FIGS. 1-2 show one example of a typical combustion chamber cooling insert 10. FIG. 1 illustrates the internal geometry. The cooling insert 10 is typically made of H13 steel. The upper surface forms the casting surface 15. There is a coolant cavity 20 with a coolant inlet 25 and a coolant outlet 30. There is a baffle 35 which directs the coolant flow from the coolant inlet 25 to the coolant outlet 30 toward the top surface of the coolant cavity 20. FIG. 2 shows the bottom of the combustion chamber insert 10 with the four bolt bosses 40 and the location dowel pin 45.

The space requirements for the bolt bosses 40 and location dowel pin 45 restricts the space for the cooling chamber diameter itself. This requires a wall thickness of about 25 mm (or 50 mm total wall thickness). As a result, a combustion chamber insert with a total diameter of 75 mm has a typical coolant cavity diameter of only about 25 mm, an 85 mm insert has coolant cavity of about 35 mm, a 95 mm insert has a coolant cavity of about 45 mm, and a 105 mm insert has a coolant cavity of about 55 mm. Consequently, the cooling requirements for a SDAS of 25 microns or less are difficult to achieve with standard cooling chamber designs. The limited chamber surface area and the mass of steel above the bolt bosses cause a slow thermal response to the casting wall from the activated coolant.

SUMMARY OF THE INVENTION

One aspect of the invention is a method of cooling a cylinder head casting. In one embodiment, the method includes securing a cooling dome insert in a cylinder head casting mold, the cooling dome insert comprising an insert body having a top wall, sidewalls, and a bottom defining a cooling chamber and having a coolant inlet and a coolant outlet in fluid communication with the coolant chamber, a total thickness of the sidewalls being less than about 40 mm; introducing molten aluminum or aluminum alloy into the cylinder head casting mold; circulating coolant to the cooling chamber through the coolant inlet and coolant outlet, wherein the SDAS at the cylinder head bridge wall is about 25 microns or less.

Another aspect of the invention is a cooling dome insert. In one embodiment, the cooling dome insert includes an insert body having a top wall, sidewalls, and a bottom defining a coolant chamber therein and having a coolant inlet and a coolant out in fluid communication with the coolant chamber, a total thickness of the sidewalls being less than about 40 mm, and wherein a predicted SDAS at the cylinder head bridge wall is about 25 microns or less.

DETAILED DESCRIPTION OF THE INVENTION

Figure 1:
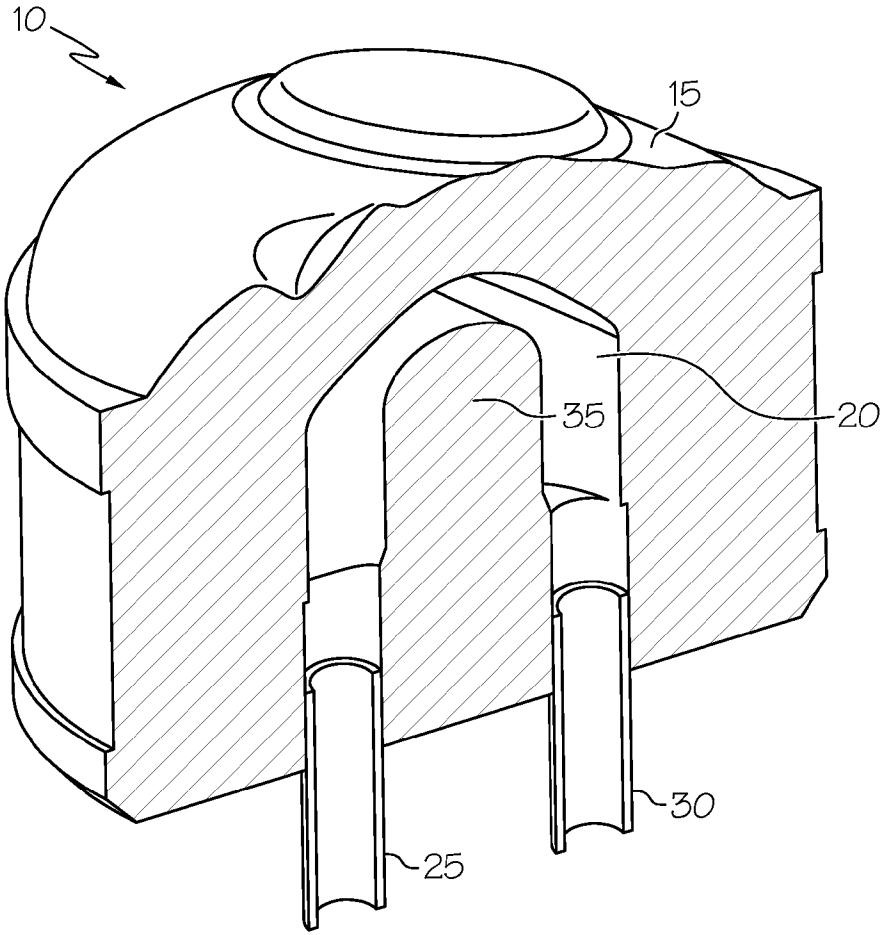
FIG. 1 is an illustration of a cross-section of a prior art design for a combustion chamber cooling insert.
Figure 2:
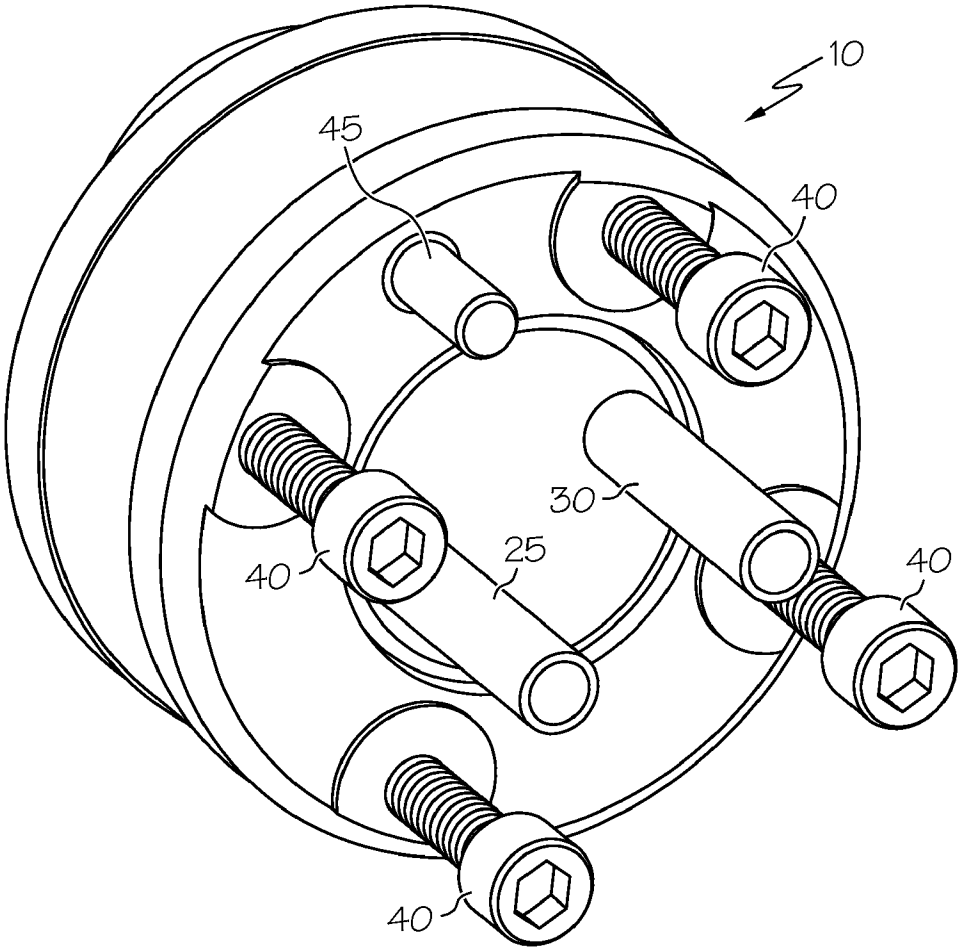
FIG. 2 is an illustration of the bottom view of the cooling insert of FIG. 1.

The innovative combustion chamber insert cooling chamber design has the rapid response time to affect the casting within the small operating window, which improves the material strength in the combustion chamber walls. The design also aids in managing the thermal energy of the metal mold and molten aluminum. It permits the use of a higher base mold temperature during mold filling, reducing the risk of cold-shut defects or a reduction in pour temperature. The reduction in casting scrap and lower energy requirements yields cost savings. Improvement in the directional solidification of the casting results in lower solidification shrinkage porosity scrap.

The design permits solidification of the combustion chamber walls in 60 sec to achieve the desired sub-25 micron SDAS. It also allows the use of the same material for the insert and the rest of the mold, which eliminates potential problems with differences in thermal expansion.

The combustion chamber insert design maximizes its diameter and the top surface area of the cooling chamber by matching the contour of the cast surface. A uniform H-13 steel wall surrounds the coolant chamber. It is generally about 8 to about 15 mm thick, typically about 10 to about 12 mm. This duplicates the minimum wall thickness in typical cooling chamber molds.

Suitable coolants include, but are not limited to, water.

The cooling cavity diameter plays an important role in the peak heat flux that the combustion chamber casting walls experience. Maximizing the peak heat flux allows a hotter mold for better mold filling conditions and a high cooling rate during solidification for improved mechanical properties.

The diameter of the inserts is typically in the range of about 75 to about 105 mm. In one embodiment, the total wall thickness is less than about 40 mm, or less than about 35 mm, or less than about 30 mm, or less than about 25 mm, or about 20 mm.

In one embodiment, allowing about 10 mm for the wall thickness on both sides (total wall thickness of about 20 mm), the coolant chamber diameter can be up to about 55 to about 85 mm depending on the insert size, e.g., up to about 55 mm for the 75 mm insert, up to about 65 mm for the 85 mm insert, up to about 75 mm for the 95 mm insert, or up to about 85 mm for the 105 mm insert.

For example, in one embodiment, for a 75 mm diameter insert, the cooling chamber diameter is at least about 30 mm, or at least about 35 mm, or at least about 40 mm, at least about 45 mm, or at least about 50 mm, or about 55 mm. For an 85 mm diameter insert, the cooling chamber diameter is at least about 40 mm, at least about 45 mm, or at least about 50 mm, or at least about 55 mm, or at least about 60 mm, or about 65 mm. For a 95 mm insert, the cooling chamber diameter is at least about 50 mm, at least about 55 mm, or at least about 60 mm, or at least about 65 mm, or at least about 70 mm, or about 75 mm. For a 105 mm insert, the cooling chamber diameter is at least about 60 mm, or at least about 65 mm, or at least about 70 mm, or at least about 75 mm, or at least about 80 mm, or about 85 mm.

In one embodiment, the ratio of the diameter of the coolant chamber to the total thickness of the walls (both sides) is generally at least about 1.12, or at least about 1.14, or at least about 1.16, or at least about 1.18, or at least about 1.2, or at least about 1.4, or at least about 1.5, or at least about 1.6, or at least about 1.7, or at least about 1.8, or at least about 1.9, or at least about 2.0, or at least about 2.1, or at least about 2.2, or at least about 2.3, or at least about 2.4, or at least about 2.5.

In one embodiment, the diameter of the coolant chamber is generally at least about 55% of the diameter of the insert body, or at least about 60%, or at least about 65%, or at least about 70%, or at least about 75%, or at least about 80%.

The design allows a coolant chamber diameter of up to about 85 mm for the 105 mm insert, resulting in a top surface area of about 7200 $mm^2$, which is over three times the top surface area of the conventional design for that size insert. For a 75 mm insert with a 55 mm coolant chamber, the top surface area is about 2400 $mm^2$, or more than seven times the top surface of the conventional design.

The insert can be formed as two pieces, if desired. The cooling chamber can be machined into each component, and the components assembled and welded together. Because the mounting and locating holes are the same as in the conventional design, they can be implemented into the standard base mold design without modifications.

The milled and welded insert design eliminates the space restriction on the back of the insert because the cooling chamber can be directly above the boss features, which is not possible in the prior art design. This allows the improved design to achieve the required heat flux increase.

The weld is positioned below the deck face surface and away from the metal front so that it would not come in contact with the molten aluminum. A 10 mm mold wall thickness has been used safely in the casting of pistons for many years. The use of a similar material for the insert and base mold (e.g., H-13) reduces the risk of stresses due to thermal expansion. The only physical loading of the combustion chamber insert is during the ejection of the aluminum casting, which would be a negligible stress on the weld. With proper welding and inspection techniques, this design will operate safely for the life of the cell.

The design helps to improve the strength of the cast material in the combustion chamber wall of an aluminum alloy cylinder head casting by increasing the cooling rate during solidification. The improvement can be obtained within the standard mold design window of the semi-permanent mold process.

Figure 3:
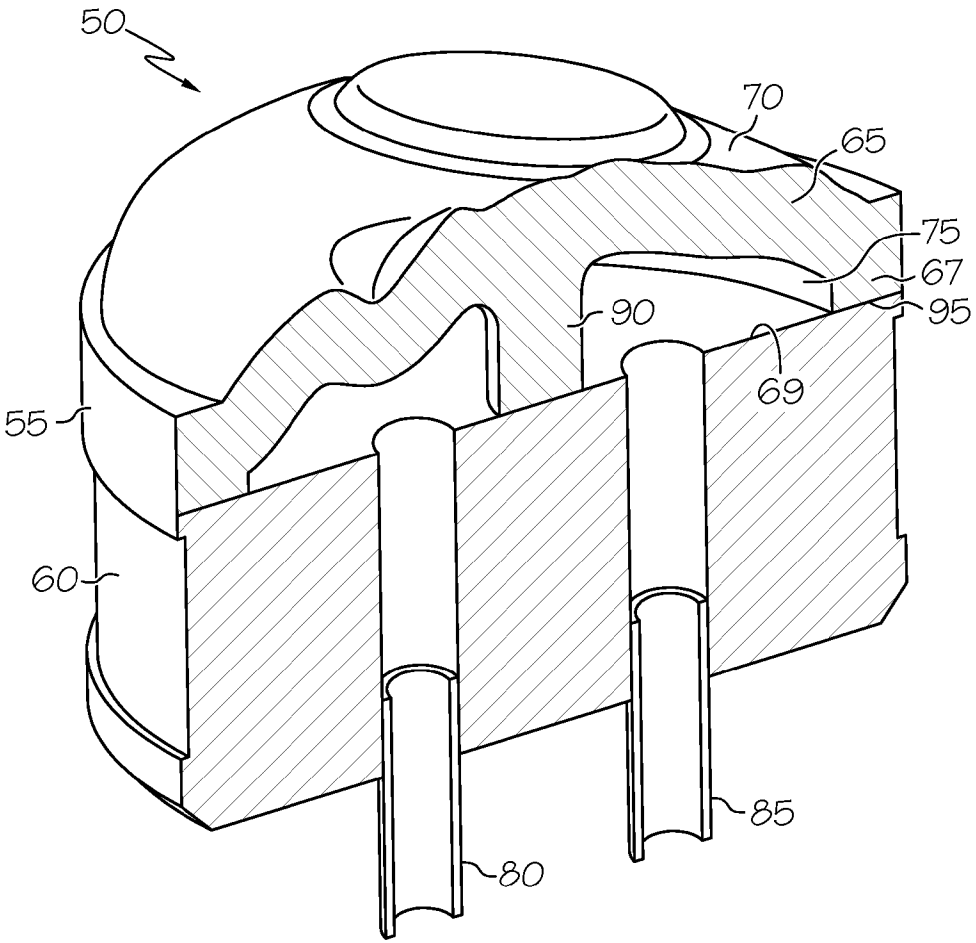
FIG. 3 is an illustration of one embodiment of a combustion chamber cooling insert of the present invention.

FIG. 3 illustrates one embodiment of an improved dome cooling design. The cooling insert 50 is cast in two parts, an upper part 55 and a lower part 60. The cooling insert has a top wall 65, sidewalls 67, and a bottom 69 which define the cooling chamber 75. The upper wall 65 between the casting surface 70 and the cooling chamber 75 has a uniform thickness because the cooling chamber 75 follows the dome of the combustion chamber. Coolant enters through the coolant inlet 80 and exits through the coolant outlet 85. If desired, there can be one or more support posts 90 in contact with the upper wall 65 which minimizes the risk of affecting the cast wall dimensions. The support posts 90 can be attached to the upper wall 65, if desired, in any suitable way, including but not limited to, welding or threads. The upper part 55 and lower part 60 are typically welded together at weld 95.

For an A319 alloy, the predicted SDAS range for the entire combustion face was 23 to 38 microns for the prior art design, while it was 20 to 27 microns for the improved design. Thus, the dome cooling improved the SDAS at the bridge wall from 23 to 20 microns, the maximum SDAS was reduced from 38 to 27 microns, and the overall SDAS range was reduced from 15 to 7 microns. The finer microstructure increases the strength of the cast material.

Figure 4:
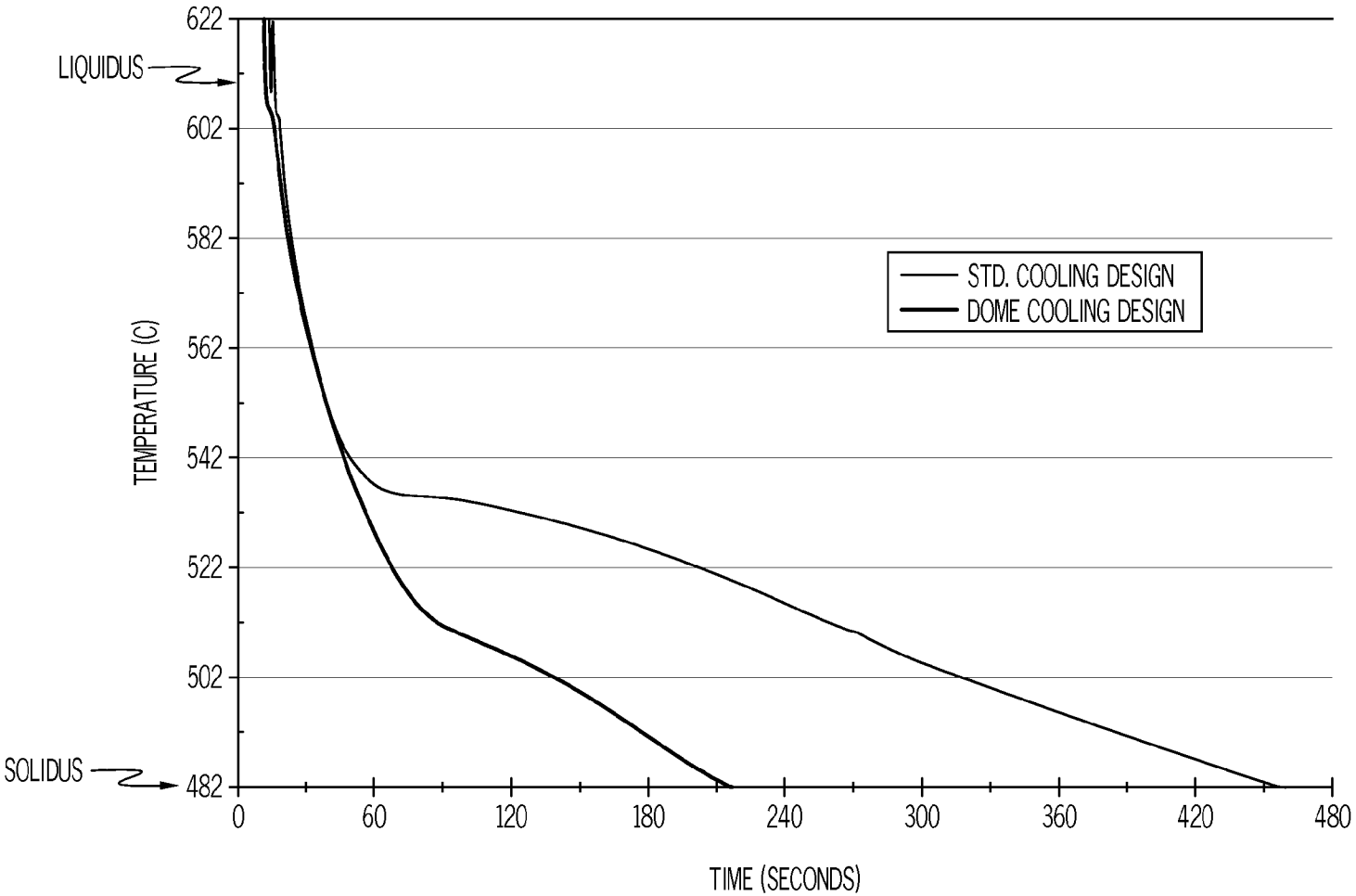
FIG. 4 is a graph showing the thermal history in the combustion chamber bridge.

FIG. 4 illustrates the improved cooling provided the dome cooling compared to the prior art design. The solidification time of the combustion chamber bridge wall was reduced by over 50%, from 450 sec to 215 sec.

Figure 5:
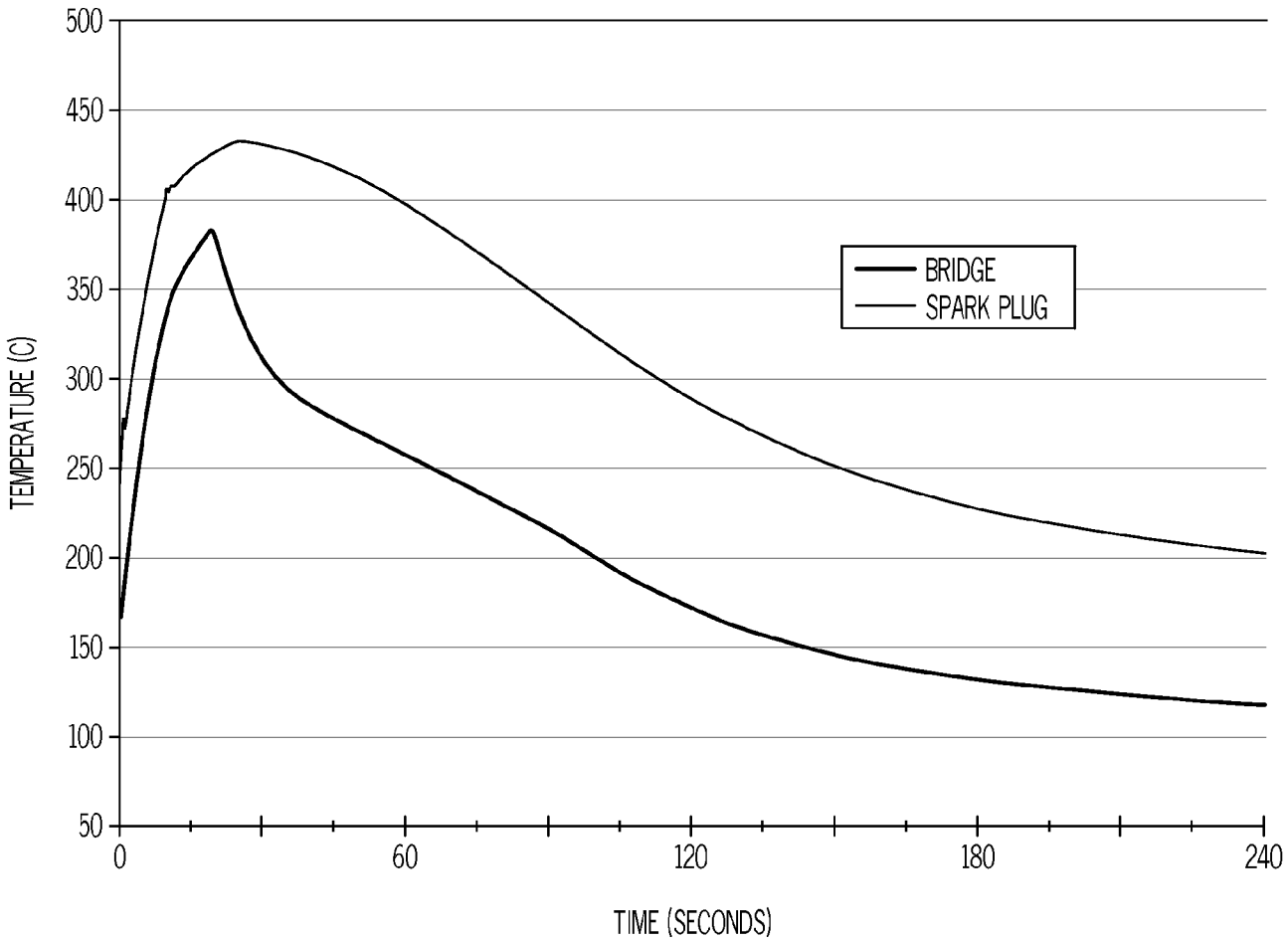
FIG. 5 is a graph showing the surface temperature for the cooled insert of the prior art design of FIG. 1.

FIG. 5 shows the insert surface temperatures for the bridge location and the spark plug location for the prior art design. At 60 sec, the surface temperature ranged from 250° C. to 395° C., a difference of 145° C. The high temperature gradient across the combustion chamber results in undesirable larger microstructure features outside of the bridge.

Figure 6:
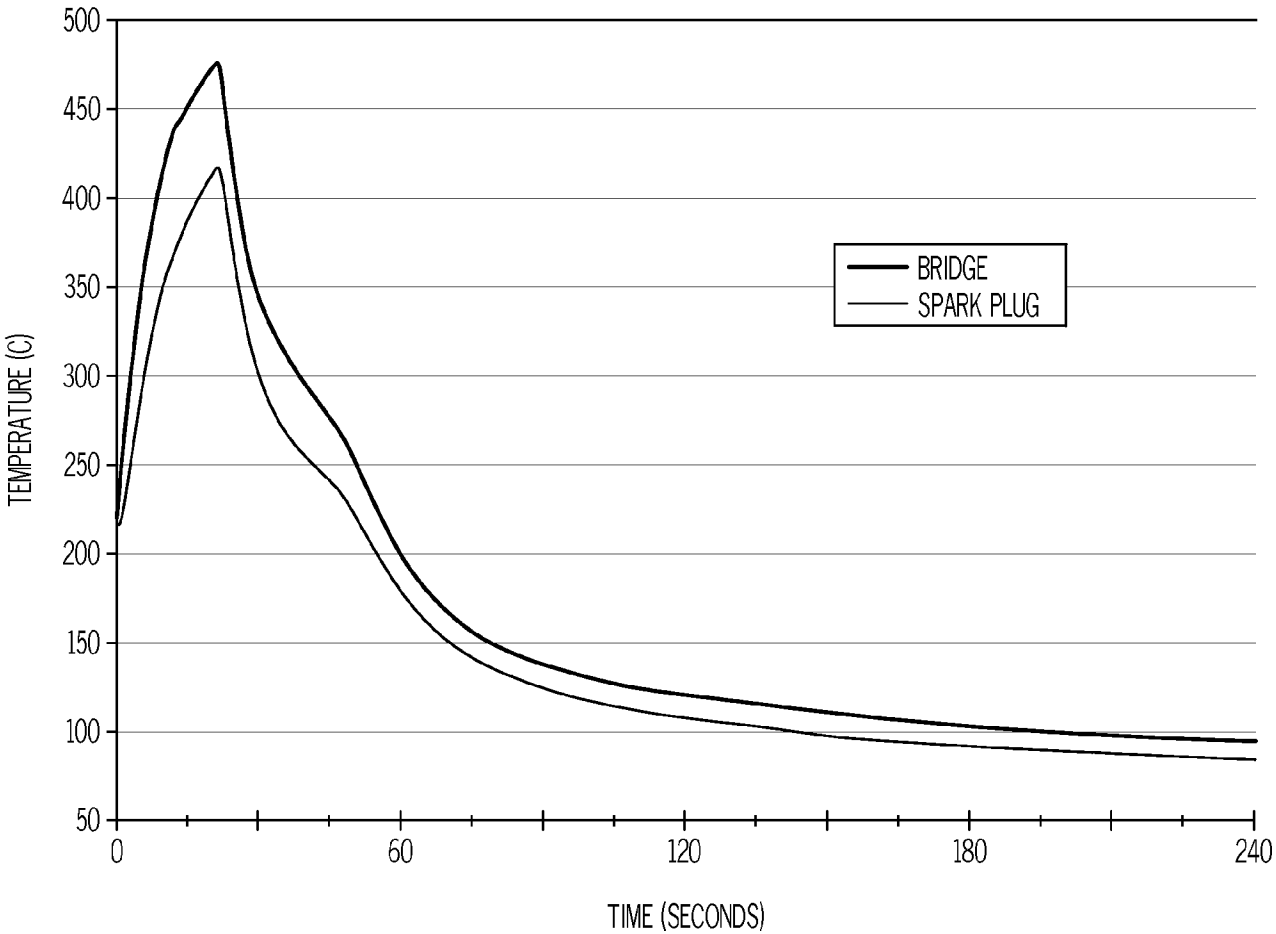
FIG. 6 is a graph showing the surface temperature for the cooled insert of the FIG. 3 embodiment of the present invention.

For the cooling dome insert, the surface temperature ranged from 180° C. to 195° C. at 60 sec, as shown in FIG. 6. The uniform wall thickness above the coolant chamber provided a near uniform cooling of the combustion chamber walls and uniformly fine microstructure.

It is noted that terms like "preferably," "commonly," and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

For the purposes of describing and defining the present invention it is noted that the term "device" is utilized herein to represent a combination of components and individual components, regardless of whether the components are combined with other components. For example, a "device" according to the present invention may comprise an electrochemical conversion assembly or fuel cell, a vehicle incorporating an electrochemical conversion assembly according to the present invention, etc.

For the purposes of describing and defining the present invention it is noted that the term "substantially" is utilized herein to represent the inherent degree of uncertainty that may be attributed to any quantitative comparison, value, measurement, or other representation. The term "substantially" is also utilized herein to represent the degree by which a quantitative representation may vary from a stated reference without resulting in a change in the basic function of the subject matter at issue.

Having described the invention in detail and by reference to specific embodiments thereof, it will be apparent that modifications and variations are possible without departing from the scope of the invention defined in the appended claims. More specifically, although some aspects of the present invention are identified herein as preferred or particularly advantageous, it is contemplated that the present invention is not necessarily limited to these preferred aspects of the invention.

What is claimed is:

1. A method of cooling a cylinder head casting comprising:

securing a cooling dome insert in a cylinder head casting mold, the cooling dome insert comprising an insert body having a top wall, sidewalls, and a bottom defining a cooling chamber and having a coolant inlet and a coolant outlet in fluid communication with the coolant chamber, a total thickness of the sidewalls being less than about 40 mm;

introducing molten aluminum or aluminum alloy into the cylinder head casting mold;

circulating coolant to the cooling chamber through the coolant inlet and coolant outlet so that a SDAS at a cylinder head bridge wall is about 25 microns or less.

2. The method of claim 1 wherein the total thickness of the sidewalls is less than about 30 mm.

3. The method of claim 1 wherein the insert body comprises an upper part and a lower part attached to the upper part.

4. The method of claim 3 wherein the lower part is attached to the upper part by welding.

5. The method of claim 1 wherein the insert body further comprises at least one support post in contact with the top wall of the cooling chamber.

6. The method of claim 5 wherein the support post is connected to the top wall of the cooling chamber by welding or threads.

7. The method of claim 1 wherein the coolant is water.

8. The method of claim 1 wherein a diameter of the cooling chamber is at least about 55% of a diameter of the insert body.

9. The method of claim 1 wherein a ratio of the diameter of the cooling chamber to the total thickness of the sidewalls is at least about 1.12.

10. The method of claim 1 wherein the top wall of the cooling chamber has a uniform thickness.

* * * * *